United States Patent [19]

Thoms

[11] 4,389,592

[45] Jun. 21, 1983

[54] COLOR PICTURE TUBE AND APERTURE MASK THEREFOR

[75] Inventor: Roland Thoms, Mullheim, Fed. Rep. of Germany

[73] Assignee: Buckbee-Mears Company, St. Paul, Minn.

[21] Appl. No.: 343,149

[22] Filed: Jan. 28, 1982

Related U.S. Application Data

[63] Continuation of Ser. No. 148,682, May 12, 1980, abandoned.

[51] Int. Cl.[3] ..... H01J 29/07

[52] U.S. Cl. ..... 313/403

[58] Field of Search ..... 313/403, 402

[56] References Cited

U.S. PATENT DOCUMENTS

| | | | |
|---|---|---|---|
| 2,690,518 | 9/1954 | Fyler et al. | 313/404 |
| 3,770,434 | 11/1973 | Law | 430/5 |
| 3,787,939 | 1/1974 | Tomita et al. | 313/402 X |
| 3,809,945 | 5/1974 | Roeder | 313/402 |
| 3,882,347 | 5/1975 | Suzuki et al. | 313/403 |
| 3,883,770 | 5/1975 | Yamada et al. | 313/403 |
| 3,916,243 | 10/1975 | Brown | 313/403 |

*Primary Examiner*—Palmer C. Demeo

*Attorney, Agent, or Firm*—Jacobson and Johnson

[57] ABSTRACT

A television tube having an electron gun and an aperture mask with a plurality of line of sight openings in the aperture mask wherein the line of sight openings in the aperture mask are partially defined by material on the cone side surface of the aperture mask and partially defined by material on the grade side surface of the aperture mask with the aperture mask located in the television tube with the cone side of the aperture mask facing the electron guns.

6 Claims, 7 Drawing Figures

FIG. 4
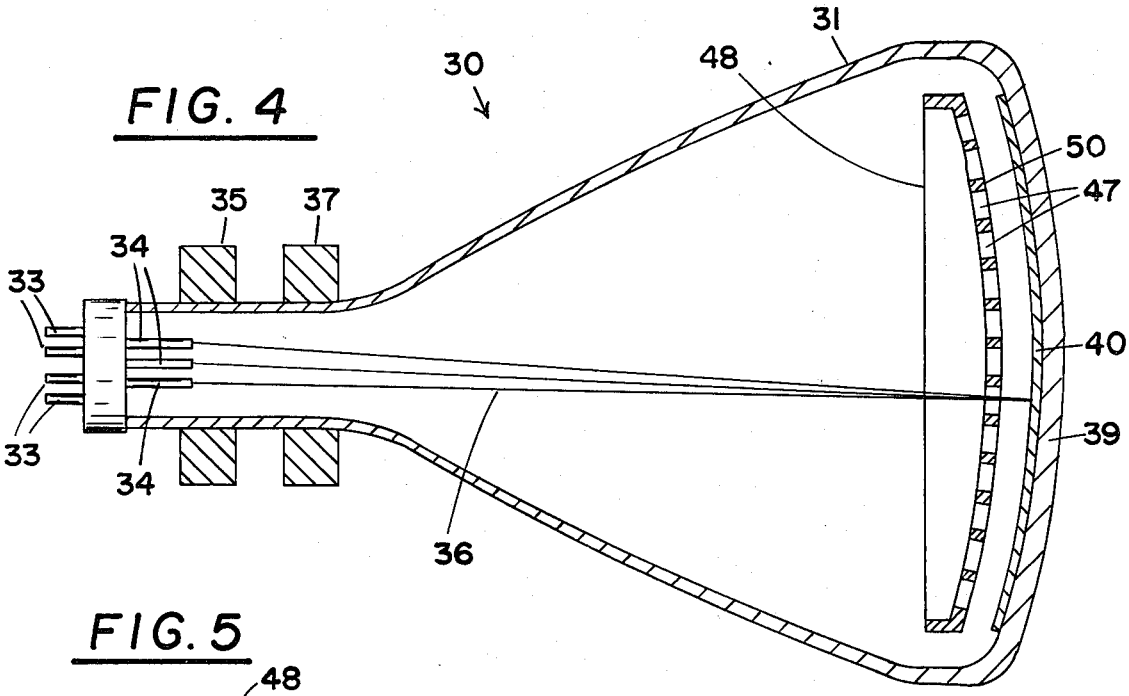
FIG. 5
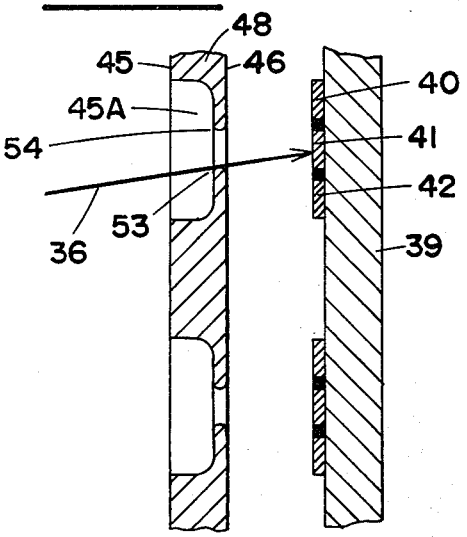
FIG. 6
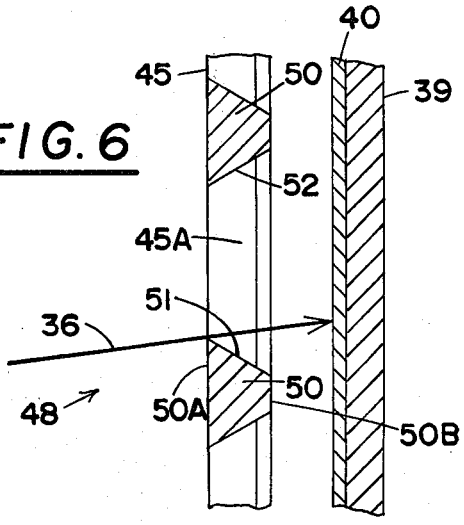
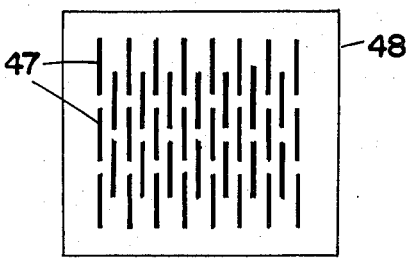
FIG. 7

COLOR PICTURE TUBE AND APERTURE MASK THEREFOR

This is a continuation of application Ser. No. 148,682, filed May 12, 1980, and now abandoned.

BACKGROUND OF THE INVENTION

1. Field of the Invention

This invention relates generally to television picture tubes and, more specifically, to television picture tubes having aperture masks with a plurality of line of sight openings therein with the grade side of the aperture mask located adjacent the phosphor screen.

2. Description of the Prior Art

The prior art concept of color television tubes is old in the art as evidenced by numerous patents thereon. Typical of the prior art color television aperture picture tubes is the Fyler, et al. U.S. Pat. No. 2,690,518 which discloses a glass tube with three electron guns located at the rear of the tube. The electron guns direct a beam of electrons at a television aperture mask or shadow mask which is made of a thin metal sheet. Located adjacent the aperture mask and on the opposite end of the tube is a glass face plate. On the face plate there are groups of three phosphor dots or stripes which comprise the three primary colors, red, blue and green. The aperture mask openings are located with respect to the phosphor dots so that electrons from each gun will strike only the phosphor dot or phosphor stripes associated with the opening in the mask. Because of problems in accurately etching the small holes in an aperture mask, the industry has developed etching procedures that require removing a mass of metal from one surface of the aperture mask. This process in effect provides a thinner section on portions of the mask. Since the section is thinner one can accurately etch smaller openings in the thinned sections of aperture mask as opposed to aperture masks with unthinned sections. In a mask etched in this manner the side where the most metal is removed is denoted as the cone side and the opposite side as the grade side. Because of the resulting geometry of the etched opening the grade side of the mask is positioned toward the electron gun with the cone side toward the phosphor screen.

The various types of aperture masks for use in color television tubes include slot masks having elongated slots which are shown in the Yamada, et al U.S. Pat. No. 3,883,770. Yamada shows a series of elongated slots with a bridge or tie bar located between the slots to provide structural strength for the mask. The bridge or tie bar are located on the grade side of the aperture mask that faces the electron gun with the cone side facing the phosphor screen.

The Roeder prior art U.S. Pat. No. 3,809,945 shows an aperture mask for use having a plurality of additional rows of apertures which are etched partway through on the periphery of the aperture mask to provide an intermediate yield strength to the aperture mask.

Another type of prior art mask is shown in the Tomita U.S. Pat. No. 3,787,939 which shows a two material aperture mask which has been etched from opposite sides. The Tomita patent (FIG. 1) illustrates the operating position of the electron beams emanating through the opening from the grade side of the mask. The configuration of each perforation is in the form of a frustum of a cone with the larger diameter cone being on the side located adjacent the phosphor screen.

A method of laying down the phosphor pattern is shown in the Law U.S. Pat. No. 3,770,434 which uses a coating of materials on opposite sides of the mask.

In the prior art television tubes inventions, particularly those utilizing elongated slots, it has been the standard procedure to mount the aperture mask with the grade side facing the electron gun and the cone side facing the phosphor screen to thereby minimize electron scattering which produces inferior color.

The Suzuki, et al U.S. Pat. No. 3,882,347 shows a television slot mask with elongated slots. Note, FIG. 4 reveals the enlarged or cone side toward the face plate and the grade side toward the electron guns. FIG. 2 shows tie bars or bridges which are located on the ends of the slot with the wider portion of the tie bars facing toward the grade side rather than the cone side.

The present invention comprises improvement to television tubes which comprise a television tube with an aperture located therein having the cone side facing the electron guns and the aperture mask having line of sight openings formed by portions of surfaces on the opposite side of the mask forming the boundaries of the line of sight openings. The resulting television picture tube has greater brightness and color purity than prior art television tubes.

SUMMARY OF THE INVENTION

Briefly, the present invention comprises a television picture tube having an aperture mask with a plurality of line of sight openings. The aperture masks comprise a sheet of material having a line of sight opening wherein a portion of the edges of the line of sight opening is partially defined by the cone side surface material and the remainder of the edges of the line of sight openings defined by the grade side material with the cone side of the aperture mask located facing the electron guns and the grade side facing the phosphor stripes.

BRIEF DESCRIPTION OF THE DRAWING

FIG. 4 is a cross sectional view of a television picture tube;

FIG. 5 is a partial top sectional view of an aperture mask and television tube;

FIG. 6 is a partial side sectional view of an aperture mask and television tube; and FIG. 7 is a front schematic view of an aperture mask having a plurality of openings therein.

DESCRIPTION OF THE PREFERRED EMBODIMENT

Figure 1:
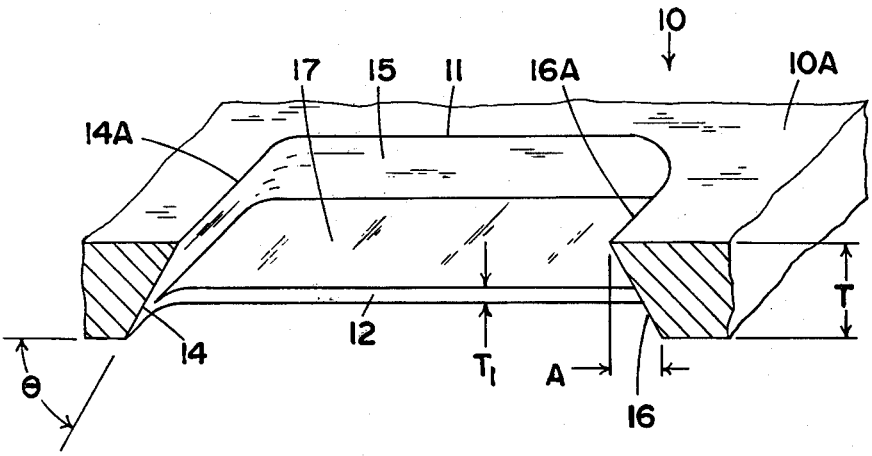
FIG. 1 is a perspective view of a single line of sight opening in a television aperture mask.
Figure 2:
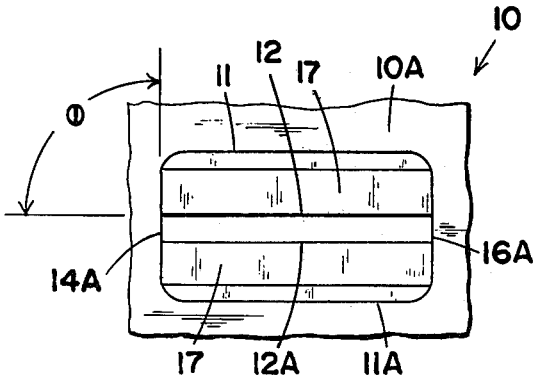
FIG. 2 is a top view or cone side view of the line of sight opening of FIG. 1.
Figure 3:
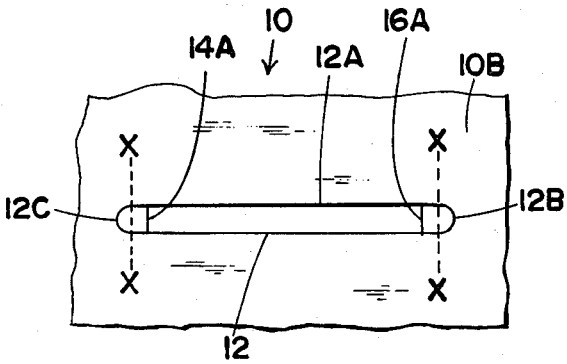
FIG. 3 is a bottom view or grade side view of the line of sight opening of FIG. 1.

Referring to FIGS. 1, 2 and 3, reference numeral 10 generally defines a portion of a television aperture mask having a cone side surface 10A and a grade side surface 10B. Surface 10A is referred to as the cone side since the larger opening or recess 15 is located therein and surface 10B is referred to as the grade side. In typical use of an aperture mask in a television picture tube the grade side faces the electron guns while the cone side faces the television picture tue. This type of positioning provides the best pictures for conventional etched masks. Located in aperture mask 10 is a line of sight opening which has edges that are defined by the cone side surface 10A and the grade side surface 10B of aperture mask 10. Located in cone side surface 10A is a recess 15 which is defined in cone side surface 10A by pair of side edges 11 and 11A and a pair of end edges 14A and 16A which are all located in the plane of cone side surface 10A of aperture mask 10. Side edges 11 and 11A connect to end edges 14A and 16A to form a closed boundary in the plane of cone side surface 10A. Thus, edges 11, 11A and edges 14A and 16A define the junction of the side walls of recess 15 with the cone side surface 10A.

The side walls of recess 15 include an undercut surface 14 and an undercut surface 16 which respectively connect to edge 14A and edge 16A. Surfaces 14 and 16 are undercut downward from cone side 10A and radially outward from edges 14A and 16A toward grade side 10B.

The thickness of aperture mask 10 is denoted by T which usually ranges from 0.004" to 0.008". The length of undercut is denoted by A. The undercut angle is denoted by $\theta$ and the thickness of the remaining material that forms the bottom of recess 15 is denoted by $T_1$ with $T_1$ being substantially less than the thickness T of aperture mask 10.

Referring to FIG. 3 (grade side), it will be noted that the bottom view shows the outline of an elongated slot in grade side surface 10B which is defined by edge 12A, edge 12, edge 12B and edge 12C which are all located in the plane of grade side surface 10B. Edges 12 and 12A are straight whereas edges 12B and 12C are curved. The portion of the opening to the outside of lines X—X defines the portion of the opening which contains curved edges 12B and 12C.

The line of sight opening through aperture mask 10 is formed by edges 12A and 12 which define the longitudinal opening and edges and 14A and 16A which define the transverse portion of the line of sight openings. Note, in the grade side view (FIG. 3) edge 12 and edge 12A also define the longitudinal opening; and edges 14A and 16A define the transverse portion of the line of sight opening. Although the grade side view of aperture mask 10 is different from the cone side view of aperture mask 10, the line of sight opening through aperture mask 10 is the same.

The two lines X—X, which are located on both ends of the elongated slot, denote the separation point between the curvature of edges 12B and 12C and straight sections 12A and 12. In the embodiment shown, lines X—X are located to the outside of edges 14A and 16A to thereby insure the line of sight opening in aperture mask 10 is comprised of a set of straight edges with substantially square corners. The curved ends are typical of cutting operations such as chemical etching.

Thus, although grade side surface 10B reveals an elongated opening therein which is substantially longer than the line of sight opening through the article, the surfaces 14 and 16, which were produced by undercutting material from edges 14A and 16A, project out sufficiently far to prevent the radiused edges 12B and 12C from forming a boundary of the line of sight opening through aperture mask 10.

In forming elongated openings in aperture mask, the process of etching permits one to etch a recess 15 in aperture mask 10. Typically, the etching process is continued until it produces a recess 15 with undercut surfaces 14 and 16. The size and shape of undercut surface can be controlled by the amount of etchant and time of etching and is generally within the skill of those in the art.

After forming recess 15 in one side, the elongated opening is etched from the opposite side. If desired, the elongated opening can be formed during the etching of the recess by simultaneously spraying etchant on opposite surfaces 10A and 10B. After etching, the elongated slot appears with radiused corners as shown in FIG. 3. In the process of forming the line of sight opening through the article, the etching continues until the etchant penetrates through the material of thickness $T_1$. After penetration, the etchant is removed typically leaving an elongated opening such as defined by edges 12A, 12B, 12C and 12D. Lines X—X denote the radius portion of elongated opening which results from the etching action.

An inspection of FIG. 3 shows the radius portion 12B and 12C project onto surfaces 15 and 16. Thus, the radiused corners 12B and 12C of aperture mask 10 do not form a part of the line of sight opening in aperture mask 10. While the article and method have been described with respect to rectangular openings. it is apparent the process can be used to make other unusually shaped line of sight openings which are difficult or impossible to make which conventional techniques.

EXAMPLE 1

To illustrate the improvement in light transmission, a conventional television aperture mask was etched having elongated slots with parallel sides and rounded ends. The dimensions of the slot were as follows:

slot width—175.2 micrometers
tie bar width—145 micrometers
slot length—613 micrometers (maximum dimension)

The measured light transmission through the slot was measured as 17.7 units.

A second aperture mask was made in accordance with the present invention in which the outline of the line of sight opening had a substantially rectangular configuration in accordance with FIGS. 1, 2 and 3. The dimensions of the rectangular line of sight opening were as follows:

slot width—174.8 micrometers
tie bar width—144 micrometers
slot length—614 micrometers.

The transmission through the opening was measured as 18.36 units or an increase of approximately 4 percent in light transmission. For the second mask, however, since the dimensions of the two holes were not exactly equal, a compensation for the area revealed that the second mask actually had an approximately 6.5 percent greater light transmission capability.

Referring to FIG. 4, reference numeral 30 generally designates a cross sectional view of a television picture tube using the line of sight aperture mask of the present invention. The television picture tube comprises a glass enclosure 31 having a base 32 and prongs 33 thereon for attachment to the electronics of the television set. Located on the exterior of the neck of the television picutre tube is a focusing coil 35 that focuses the electron beam so the electron beams converge as they pass through openings 47 in aperture mask 48. Located adjacent focusing coil 35 is a deflection coil 37 which sweeps the electron beam across aperture mask 48. The aperture mask 48 is located with a plurality of elongated openings 47 located therein. Located immediately behind elongated slots 47 is a phosphor strip 40. Although three phosphor strips are located behind each opening in the cross sectional view only one strip is visible in the cross sectional view. The phosphor strips comprise the primary colors red, blue and green which, when excited by the electrons, produce the proper color on face plate 39 of television picture tube 30.

To understand the operation of the present invention in a television picture tube, reference should be made to FIGS. 5 and 6 which respectively show a top view of a portion of the television aperture mask and a television picture tube and a side view of a television picture tube. The front glass envelope portion of the television picture tube is designated by reference numeral 39 with reference numerals 40, 41 and 42 designating the red, blue and green phosphor stripes which extend longitudinally parallel to the elongated openings which are located in aperture mask 48. FIG. 7 shows schematically the slot arrangement of a typical aperture mask having a series of elongated slots. Located between phosphor stripes 40, 41 and 42 is a suitable black light-absorbing medium that does not emit any color should it be struck by electrons.

Referring to FIG. 5, the aperture mask is denoted by reference numeral 48 and with cone side 45 facing the electron gun and the grade side 46 facing the phosphor stripes which are lcoated on face plate 34. Since the most metal is removed from side 45 to provide recess 45A, this side is denoted as the cone side and is located facing the electron gun. Typical prior art aperture masks the cone side was located facing the phosphor side. FIG. 5 reveals how the grade side edge surfaces 53 and 54 limit the electrons in the lateral direction.

FIG. 6 shows a side view of aperture mask 48 with reference numeral 39 denoting the face plate and reference numeral 40 indicating a phosphor stripe. The aperture masks 48 has an opening 45A in the cone side 45 and an elongated opening on the opposite side. The tie bar or bridges as they refer to in the prior art are located with the narrow end of the bridge or tie bar facing the phosphor stripe 40 and the tie bar extending from the cone side 45 to grade side 46. FIG. 6 shows tie bar 50 to comprise a grade side surface 50B, a cone side surface 50A and an interior surface 51 in lower tie bar and an upper interior surface 52 on upper tie bar 50. The upper and lower boundaries of the line of sight opening in aperture mask 48 is defined by the junction of surface 52 with cone side surface 44 and junction of surface 51 with cone side surface 45.

In practice the plurality of tie bars located in the spaced relationship provide for accurate defining of an opening for the excitation of the phosphor stripes located along the television picture tube.

Note, if the aperture masks have the cone side facing the electron gun, one should have the bottom of the recess region, which is located adjacent the sides of the line of sight openings, be sufficiently flat or angled so that the electron beams that impinge on the bottom of the recess region do not deflect through the line of sight opening in the aperture mask. Typically, if the bottom of the recess region is parallel to the mask cone side surface, one does not obtain scattering electron reflections through the line of sight openings.

In addition, with the aperture mask cone side facing the electron guns the portion of the recess side walls which do not define a portion of the line of sight opening should be set sufficiently far back from the line of sight opening in the aperture mask so that the path of the electron beam is not obstructed by the recess region side walls or the cone side surface of the aperture mask.

I claim:

1. A color television tube comprising:

an enclosure having a viewing surface on one end with a plurality of phosphor regions for generating light of three primary colors on the viewing surface of said enclosure, at least one electron gun to excite said phosphor regions;

an aperture mask located proximate said viewing surface, said aperture mask having a plurality of line of sight openings, said aperture mask having a first side and a second side, said aperture mask first side having an edge which defines an outline of a portion of a line of sight opening in said first side of said aperture mask;

said aperture mask second side surface having an edge which defines an outline of a portion of a line of sight opening in said second side of said aperture mask so that a line of sight opening of said plurality of line of sight openings comprises an opening for electrons to pass through which is partially bounded by said edge on said aperture mask first side and partially bounded by said edge on said aperture mask second side, said aperture mask positioned between said electron gun and said phosphor regions with said aperture mask first side facing said viewing surface and said aperture mask second side facing said electron gun to thereby permit said second side of said mask to act as a shield to prevent electrons from impinging on the improper phosphor region.

2. The invention of claim 1 wherein said openings have side walls that are undercut from said edges of said first side and said second side.

3. The invention of claim 2 wherein said aperture mask includes tie bars located between said line of sight openings.

4. The invention of claim 3 wherein said line of sight openings have a rectangular shape.

5. The invention of claim 4 wherein said aperture masks include line of sight openings located end to end with tie bars having a trapezoidal shape located between end to end openings.

6. The invention of claim 4 wherein the said tie bar has its widest portion facing said electron gun.

* * * * *